United States Patent [19]

Gould

[11] 4,394,556

[45] Jul. 19, 1983

[54] CAM OPERATED SWITCH ASSEMBLY

[75] Inventor: Gilbert Gould, Thousand Oaks, Calif.

[73] Assignee: The United States of America as represented by the Secretary of the Navy, Washington, D.C.

[21] Appl. No.: 352,822

[22] Filed: Feb. 26, 1982

[51] Int. Cl.[3] ..... H01H 17/16

[52] U.S. Cl. ..... 200/161; 200/327

[58] Field of Search ..... 200/161, 153 F, 153 T, 200/153 LB, 327, 338; 102/260, 261, 262; 89/1.5 D; 441/11, 12, 13, 16

[56] References Cited

U.S. PATENT DOCUMENTS

| | | | |
|---|---|---|---|
| 2,573,833 | 11/1951 | Christensen | 200/153 T X |
| 3,165,059 | 1/1965 | Saunders | 102/83 |
| 3,878,344 | 4/1975 | Lockard | 200/6 |
| 3,900,709 | 8/1975 | Sheesley et al. | 200/5 |
| 3,928,739 | 12/1975 | Miyamae | 200/155 R |
| 4,031,339 | 6/1977 | Koch | 200/38 |
| 4,081,632 | 3/1978 | Schaffeler | 21/80 |

FOREIGN PATENT DOCUMENTS

| | | | |
|---|---|---|---|
| 577273 | 4/1946 | United Kingdom | 89/1.5 D |

*Primary Examiner*—John W. Shepperd
*Assistant Examiner*—Renee S. Kidorf

[57] ABSTRACT

A switch assembly is provided for connecting a battery to an electronic assembly which is part of a sonobuoy which is deployed from an aircraft. A normally-closed micro-switch is connected in a battery circuit and a rotatable cam depresses a lever arm on the micro-switch to open the circuit. A lanyard, having one end attached to an aircraft, is attached to the rotatable cam and launching of the sonobuoy causes the lanyard to rotate the cam and release the lever arm of the micro-switch. A safe pin prevents rotation of the cam until the safe pin is removed prior to launch.

9 Claims, 2 Drawing Figures

CAM OPERATED SWITCH ASSEMBLY

BACKGROUND OF THE INVENTION

The present invention relates to a switching system and more particularly to a switching system for connecting a battery to an electronic unit which is deployed from an aircraft.

A sonobuoy is provided with a surface electronic unit which is battery operated. Although the sonobuoy is an expendable unit, it is desirable for the surface electronic unit to operate a sufficient length of time to complete its mission. In order to conserve the battery power, it is desirable that the battery not be turned-on until the sonobuoy is launched.

Lanyard operated devices have been employed in the past to arm various military devices which are air-launched. These devices, however, either are of the breakaway type, that is the lanyard breaks, or the lanyard has various hardware devices on the end which move around and can cause damage to an aircraft.

SUMMARY OF THE INVENTION

The present invention relates to a switching system and more particularly to a switch for turning on a battery of a surface electronic unit of a sonobuoy which is launched from an aircraft.

A normally-closed switch is connected with a battery circuit and a switch lever arm is depressed by a cam which opens the circuit. The cam is rotatably mounted, but is prevented from rotating by a safe pin which is removed prior to launch of the sonobuoy. A lanyard is attached to the cam and, upon launch, the lanyard rotates the cam to release the lever arm of the switch. The lanyard has its end attached in an open-ended slot in the cam and, after the cam is rotated about ninety degrees, the lanyard disengages the slot without breaking.

It is therefore a general object of the present invention to provide an improved device for connecting a battery to an electronic unit.

Another object of the present invention is to provide a switch assembly for energizing an electronic unit upon deployment from an aircraft.

Other objects, advantages and novel features of the invention will become apparent from the following detailed description of the invention when considered in conjunction with the accompanying drawing.

DESCRIPTION OF THE PREFERRED EMBODIMENT

Figure 1:
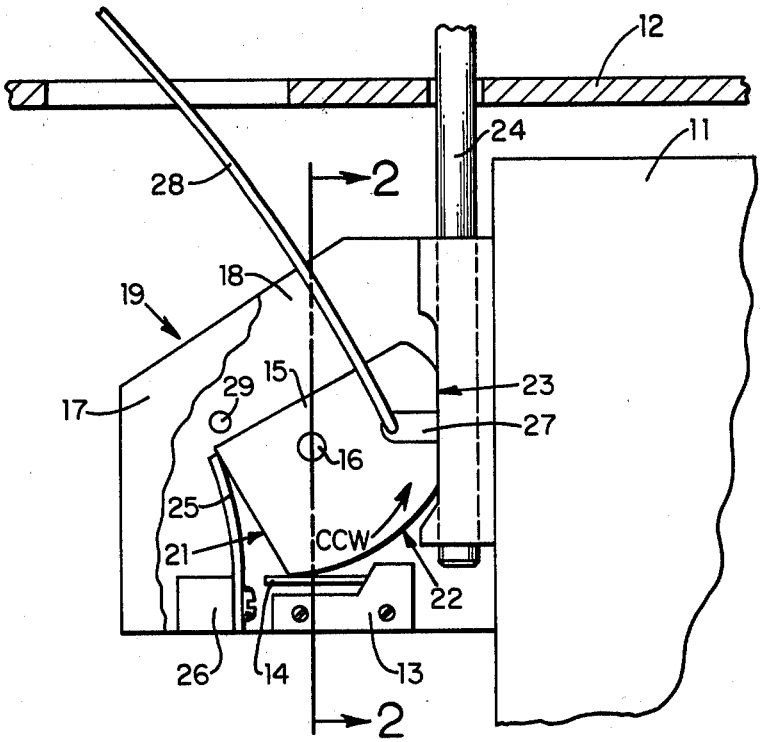
FIG. 1 is a side view, partially broken away, of a preferred embodiment.
Figure 2:
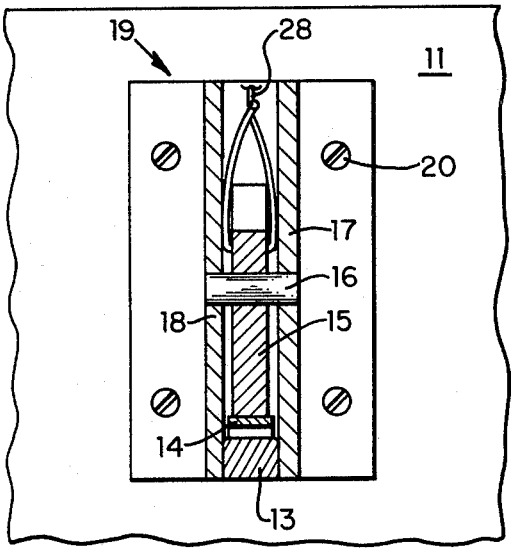
FIG. 2 is a sectional view taken on line 2—2 of FIG. 1, but not showing a safe pin.

Referring now to the drawing, a surface electronic unit 11 is shown positioned within a sonobuoy tube 12. A battery (not shown) is positioned inside surface electronic unit 11 and supplies the power necessary to operate electronic unit 11. In order to conserve battery power, it is desirable that the battery not be turned-on until the sonobuoy has been launched from an aircraft. A normally closed micro-switch 13 is connected in the battery circuit and the battery is not turned-on until switch 13 is actuated.

Micro-switch 13 is provided with a lever arm 14 and, when lever arm 14 is depressed, micro-switch 13 is "open" and no battery current is supplied to the surface electronic unit 11. Cam 15, which is rotatably mounted on shaft 16, is supported by arms 17 and 18 of a bracket 19. Bracket 19 is attached to electronic unit 11 by screws 20. Cam 15 is provided with a flat surface 21 and, as shown in FIG. 1 of the drawing, which is a pre-launch condition, cam 15 has a curved surface 22 which depresses switch lever arm 14, however, when cam 15 is rotated in a counter-clockwise direction, flat surface 21 permits switch lever arm 14 to raise and micro-switch 13, which is a normally-closed switch, turns on the battery in electronic unit 11.

Cam 15 is provided with a second flat surface 23 and, prior to sonobuoy launch, a safe pin 24 is positioned in bracket 19 and engages flat surface 23 and prevents rotation of cam 15. Also, a stop pin 29 is attached to bracket 19 and prevents cam 15 from being rotated in a clockwise direction. Upon removal of safe pin 24, cam 15 can be rotated in a counterclockwise direction, however, a leaf spring 25, which is attached to support 26, provides a biasing force which must be overcome before cam 15 can be rotated. Cam 15 is provided with a slot 27 which extends from flat surface 23 and a lanyard 28 has a loop which engages in slot 27. One end of lanyard is attached to a suitable part of the aircraft which is carrying a sonobuoy.

In operation, safe pin 24 is removed prior to launch and, after removal, cam 15 is capable of turning in a counterclockwise direction. Stop pin 29 prevents cam 15 from turning in a clockwise direction. Spring 25 maintains a biasing force on cam 15. Upon launching sonobuoy tube 12 from an aircraft, lanyard 28, which has one end attached to the aircraft, causes cam 15 to rotate and flat surface 21 on cam 15 permits lever arm 14 to rise and micro-switch 13 assumes its normally closed position thereby connecting a battery in circuit with electronic unit 11. When cam 15 has rotated about ninety degrees, lanyard 28 is disengaged from slot 27 without breaking of lanyard 28.

It can thus be seen that the present invention provides a relatively simple and inexpensive device for turning on a battery of a sonobuoy during launch.

Obviously many modifications and variations of the present invention are possible in the light of the above teachings. It is therefore to be understood that the invention may be practiced otherwise than as specifically described.

I claim:

1. A switching system for connecting battery power to an electronic unit comprising, a normally-closed switch having an operable lever arm, a rotatable cam having a curved surface for depressing said lever arm to open said switch, a lanyard, means in said cam for releasably attaching one end of said lanyard thereto, and means engageable with said cam for preventing rotation of said cam.

2. A switching system for connecting battery power to an electronic unit as set forth in claim 1 wherein said means in said cam for releasably attaching one end of said lanyard thereto comprises an open-ended slot extending from an edge of said cam.

3. A switching system for connecting battery power to an electronic unit as set forth in claim 2 wherein said cam has a flat surface thereon adjacent said curved surface and wherein said means for preventing rotation of said cam comprises a safe pin in abutment with said flat surface.

4. A switching system for connecting battery power to an electronic unit as set forth in claim 3 wherein said open-ended slot extends from said flat surface and said safe pin closes said slot to prevent disengagement of lanyard from said slot until said safe pin is removed.

5. A switching system for connecting battery power to an electronic unit as set forth in claim 1 having a stop pin for preventing rotation of said cam in one direction.

6. A switching system for connecting battery power to an electronic unit as set forth in claim 1 having spring means biasing said cam against rotation until said cam is rotated by a force applied to said lanyard.

7. A switching system for connecting battery power to an electronic unit comprising, a normally-closed switch having an operable lever arm, a rotatable cam having a curved surface for depressing said lever arm to open said switch and having a first flat surface adjacent said curved surface, a lanyard, an open-ended slot in said cam extending from said first flat surface for removably holding one end of said lanyard, and a safe pin in abutement with said first flat surface for preventing rotation of said cam, said safe pin closing said slot to prevent disengagement of said lanyard from said slot until said safe pin is removed.

8. A switching system for connecting battery power to an electronic unit as set forth in claim 7 having a stop pin for preventing rotation of said cam in one direction.

9. A switching system for connecting battery power to an electronic unit as set forth in claim 7 having spring means biasing said cam against rotation until said cam is rotated by a force applied to said lanyard.

* * * * *